US008303271B2

(12) United States Patent
Ikeda et al.

(10) Patent No.: US 8,303,271 B2
(45) Date of Patent: Nov. 6, 2012

(54) ELECTRIC COMPRESSOR INTEGRAL WITH DRIVE CIRCUIT

(75) Inventors: Hideo Ikeda, Isesaki (JP); Eiji Kobayashi, Isesaki (JP); Kazumi Ohsato, Maebashi (JP); Masanori Taguchi, Takasaki (JP); Shigeyuki Koyama, Isesaki (JP); Suguru Okazawa, Maebashi (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 197 days.

(21) Appl. No.: 12/680,064

(22) PCT Filed: Aug. 27, 2008

(86) PCT No.: PCT/JP2008/065279

§ 371 (c)(1),
(2), (4) Date: Mar. 25, 2010

(87) PCT Pub. No.: WO2009/041208

PCT Pub. Date: Apr. 2, 2009

(65) Prior Publication Data

US 2010/0209266 A1 Aug. 19, 2010

(30) Foreign Application Priority Data

Sep. 25, 2007 (JP) ..... 2007-246772

(51) Int. Cl.
*F04B 39/06* (2006.01)

(52) U.S. Cl. ..... 417/371; 417/366; 417/410.1

(58) Field of Classification Search ..... 417/366, 417/371

See application file for complete search history.

(56) References Cited

U.S. PATENT DOCUMENTS 6,501,662 B2 * 12/2002 Ikeda ..... 361/760
6,599,104 B2 * 7/2003 Saito et al. ..... 417/366
7,083,399 B2 * 8/2006 Kurihara et al. ..... 417/423.7

(Continued)

FOREIGN PATENT DOCUMENTS

JP H07042669 A 2/1995

(Continued)

OTHER PUBLICATIONS

Japanese Patent Office, International Search Report, for International Application No. PCT/JP2008/065279, mailed (Sep. 22, 2008).

*Primary Examiner* — Charles Freay
(74) *Attorney, Agent, or Firm* — Baker Botts L.L.P.

(57) ABSTRACT

An electric compressor integral with a drive circuit incorporates a compression mechanism section, a motor for driving the compression mechanism section, and a motor drive circuit. A refrigerant gas chamber having a refrigerant gas expansion space, into which refrigerant gas is introduced, is formed between a drive circuit installation section and a motor installation section, by a first partition wall provided on the drive circuit side and a second partition wall provided on the motor side, the side opposite the drive circuit side. The refrigerant gas chamber is interrupted by the first partition wall against the drive circuit installation section and is communicated with the motor installation section by a through hole that is provided in the second partition wall and through which the refrigerant gas can pass. Heat generating components, particularly in the drive circuit, can be easily and effectively cooled, and also on the motor installation side, cooling of the motor and lubrication of a bearing section can be easily and excellently performed.

22 Claims, 10 Drawing Sheets

U.S. PATENT DOCUMENTS

| | | | | |
|---|---|---|---|---|
| 7,179,068 | B2 * | 2/2007 | Makino et al. | 418/55.4 |
| 2002/0039532 | A1 | 4/2002 | Saito et al. | |

FOREIGN PATENT DOCUMENTS

| | | | |
|---|---|---|---|
| JP | 2000291557 | A | 10/2000 |
| JP | 2001263243 | A | 9/2001 |
| JP | 2002174178 | A | 6/2002 |
| JP | 2002-188573 | A | 7/2002 |
| JP | 2002188574 | A | 7/2002 |
| JP | 2005-054716 | A | 3/2005 |
| JP | 2006-286680 | A | 10/2006 |
| JP | 2007-115917 | A | 5/2007 |
| JP | 2007120505 | A | 5/2007 |

* cited by examiner

ELECTRIC COMPRESSOR INTEGRAL WITH DRIVE CIRCUIT

CROSS-REFERENCE TO RELATED APPLICATIONS

This application is the National Stage of International Patent Application No. PCT/JP2008/065279, filed Aug. 27, 2008, which claims the benefit of Japanese Patent Application No. 2007-246772, filed Sep. 25, 2007, the disclosures of which are incorporated herein by reference in their entirety.

TECHNICAL FIELD OF THE INVENTION

The present invention relates to an electric compressor integral with a drive circuit, in which the drive circuit for driving a motor is incorporated, and relates to an electric compressor integral with a drive circuit in which heat generating components can be effectively cooled.

BACKGROUND ART OF THE INVENTION

As to an electric compressor integral with a drive circuit in which the drive circuit for driving a motor is incorporated, many kinds of structures where sucked refrigerant gas is utilized for cooling the drive circuit having heat generating components are known, as disclosed in Patent documents 1-3.

Patent document 1: JP-2000-291557-A
Patent document 2: JP-2002-174178-A
Patent document 3: JP-2001-263243-A

DISCLOSURE OF THE INVENTION

Problems to be Solved by the Invention

However, a conventional cooling structure utilizing sucked refrigerant gas has not always been a structure where the drive circuit can be effectively cooled over a wide range, or a structure where a part to be desired to enhance the cooling can be effectively cooled. In addition, also known is a structure where the refrigerant gas which cooled the drive circuit of the motor is sucked through the motor mounted section into a compression mechanism section so as to cool the motor, however, this is not a structure where the motor can be effectively cooled over a wide range, or a structure where a lubrication in a motor bearing can be kept well during the cooling.

Therefore the object of the present invention is to provide a structure where a heat generating component, specifically a heat generating component in a drive circuit, can be easily cooled effectively, and where motor cooling and bearing lubrication can be easily kept well at a side of a motor installation section.

Means for Solving the Problems

To achieve the above-described object, an electric compressor integral with a drive circuit is an electric compressor integral with a drive circuit, in which a compression mechanism section and a motor for driving the compression mechanism section are contained, and into which the drive circuit for driving the motor is incorporated, characterized in that a refrigerant gas chamber having a refrigerant gas expansion space, into which refrigerant gas is introduced, is formed between an installation section of the drive circuit and an installation section of the motor by a first partition wall provided on a side of the installation section of the drive circuit and a second partition wall provided on a side opposite the drive circuit installation section side, which is a side of the installation section of the motor, wherein the refrigerant gas chamber is interrupted by the first partition wall against the installation section of the drive circuit, and is communicated with the installation section of the motor by a through hole, provided in the second partition wall, through which the refrigerant gas can pass.

In this electric compressor integral with a drive circuit, because the refrigerant gas chamber having the refrigerant gas expansion space into which refrigerant gas is introduced is formed between the installation section of the drive circuit and the installation section of the motor, the introduced refrigerant gas flows in the refrigerant gas chamber and is once trapped in the refrigerant gas chamber in a well expanded condition. Therefore, comparatively large cooling capacity for the part to be cooled can be given to the refrigerant gas in the refrigerant gas chamber, so that the part to be cooled can be cooled by the refrigerant gas more effectively. In addition, because the refrigerant gas chamber is formed by the first partition wall provided on the side of the installation section of the drive circuit and the second partition wall provided on its opposite side, which is the side of the installation section of the motor, an optimum structure for cooling the drive circuit can be employed for the first partition wall, and independently, an optimum structure for lubricating the bearing section can be employed for the second partition wall, so that target structures can be achieved more easily and more surely.

In the electric compressor integral with a drive circuit according to the present invention, it is possible that a compressor housing containing the compression mechanism section and the motor, and a drive circuit housing incorporating the drive circuit are separately composed, the first partition wall is provided in the drive circuit housing, and the refrigerant gas chamber is formed by assembling the drive circuit housing on the compressor housing. In this structure, a desirably designed refrigerant gas chamber can be easily formed if only the drive circuit housing is assembled on the compressor housing. In addition, because the compressor housing and the drive circuit housing are composed in different bodies, a shell diameter at the compressor housing side can be made larger than a shell diameter at the drive circuit housing, so that cooling surface area at the first partition wall side is ensured to be wide, and specifically, the cooling performance at the drive circuit side can be developed. In order to seal a gap between the compressor housing and the drive circuit housing which are assembled each other, a gasket or O-ring can be used, which is superior in a sealing performance and is inexpensive and long-lived.

Alternatively, it is possible that a compressor housing containing the compression mechanism section and the motor, and a drive circuit housing containing the drive circuit are composed as an integrated housing, and the refrigerant gas chamber is formed by inserting a member forming the first partition wall to be fixed into the integrated housing. In this structure, because housings are integrated, the housing itself can be easily manufactured, and a desirably designed refrigerant gas chamber can be easily formed by inserting the member different from the integrated housing forming the first partition wall to be fixed into the integrated housing.

In addition, in the electric compressor integral with a drive circuit according to the present invention, it is preferred that the through hole is provided on the second partition wall, at a position corresponding to an installation section of a sealed terminal for supplying an electricity to the motor, sealed terminal extending through the first partition wall from the drive circuit. When thus constructed, at least some of the refrigerant gas introduced thereinto is sent to the motor side through the through hole of the second partition wall after led to the sealed terminal installation section surely, so that the sealed terminal section which is required to be cooled can be cooled more surely. In addition, when most of the refrigerant gas is flowed near the sealed terminal, the cooling can be focused on the sealed terminal section and its cooling performance can be increased.

Further, it is preferred that plural through holes are provided, so that the refrigerant gas can be delivered more surely over a wide range, specifically for the motor side.

As plural through-holes, it is preferred that a through hole with a relatively larger cross section and a through hole with a relatively smaller cross section are provided. Thereby the distribution amount can be set optimum when the refrigerant gas is sent to the motor side through the second partition wall.

The sealed terminal section can be cooled more strongly, specifically when formed as the through hole with a relatively larger cross section is a through hole which is provided on the second partition wall at a position corresponding to an installation section of a sealed terminal for supplying an electricity to the motor, the sealed terminal extending through the first partition wall from the drive circuit.

Further, because the sucked refrigerant gas usually includes lubricating oil, the refrigerant gas which is sent to the motor side through the through hole on the second partition wall can be used for the lubrication. Specifically, when a through hole which communicates from the refrigerant gas chamber to a bearing section for a rotational shaft of the motor is provided on the second partition wall, the bearing section for the rotational shaft of the motor can be lubricated more adequately. By this lubricant securement, it can be expected that an abnormal noise generation from the bearing section is prevented and that a lifetime of the bearing improved.

Further, preferable is a structure where a concavo-convex structure is formed on a surface forming the refrigerant gas chamber of the first partition wall. The concavo-convex structure can increase an area, in other words a surface area of the first partition wall in the refrigerant gas chamber to cool the drive circuit side, where the heat is radiated from the drive circuit and by just that much, the cooling effect can be improved.

It is preferred that the concavo-convex structure on the surface forming the refrigerant gas chamber of the first partition wall is such as formed as a rib structure for the first partition wall. Such a rib structure can be provided integrally with the first partition wall. Formed as a rib structure, the performance of heat exchange with refrigerant gas in the refrigerant gas chamber can be improved by the surface area increase, and the first partition wall strength can be improved. Specifically when the rib structure is composed of ribs which extend like a lattice, the strength and the heat exchange performance can be further improved.

Also it is preferred that a protrusion which obstructs a flow of the refrigerant gas in the refrigerant gas chamber is provided on a surface forming the refrigerant gas chamber of the second partition wall. Such a protrusion can be formed integrally with the second partition wall.

By providing such a protrusion, refrigerant gas flows in a whirl near the protrusion in the refrigerant gas chamber, so that the detention time of the refrigerant gas becomes long because the refrigerant gas flows in a longer route. That can promote the heat exchange with components, such as a power semiconductor element, which are provided on the opposite side of the refrigerant gas chamber of the first partition wall, so that the cooling can be performed more effectively. In addition, because the amount of refrigerant gas flowing near the partition wall surface in the refrigerant gas chamber increases, further promotion of the heat exchange can be expected. Further, because the cooling of the second partition wall is further promoted for the same reason, the cooling of the bearing section of the rotational shaft of the motor provided at the opposite side of the refrigerant gas chamber relative to the second partition wall can be also promoted, so that the lifetime extension of the bearing can be expected. It is preferred that such plural protrusions are disposed. By disposing plurally, the above-described increased effect of cooling performance can be expected over a wide range in the refrigerant gas chamber.

The drive circuit usually comprises an inverter circuit having a power semiconductor element, and power circuit components such as a smoothing capacitor and a noise filter which are disposed in an electricity supply section to the inverter circuit. It is preferred that the power circuit components are disposed in a region which is partitioned relatively to the inverter circuit by a partition wall. Although such power circuit components are relatively larger so that the amount of heat generation may become greater as a whole, these components can be effectively cooled from the periphery by disposing these components in another region partitioned by the partition wall.

In addition, it is possible that the first partition wall has a region which protrudes into said refrigerant gas chamber and the power circuit components are disposed on a surface of this protruded region positioned at a side opposite to the refrigerant gas chamber. By employing this structure, at least some of these relatively larger sized components can be set in the above-described region, thereby the contact area between these components and the first partition wall can be increased and the cooling effect by the refrigerant gas chamber can be increased. Further, the axial directional size of the compressor can be shortened, so that a whole compressor can be reduced in size and weight.

Furthermore, a refrigerant gas guide plate can be provided in the refrigerant gas chamber. When the refrigerant gas guide plate is provided, refrigerant gas in the refrigerant gas chamber can be led to a desirable course and a desirable part more surely and the cooling can be performed more efficiently.

Specifically by forming the refrigerant gas guide plate into a shape which guides refrigerant gas introduced into the refrigerant gas chamber to a side of the second partition wall after guiding the refrigerant gas along the first partition wall, it is possible that the drive circuit side is cooled adequately over a wide range and that the refrigerant gas is led to the sealed terminal section more surely, so that the cooling effect can be increased as a whole.

The refrigerant gas is introduced into the refrigerant gas chamber through a suction port, which can be formed either on a drive circuit housing containing the drive circuit or on a compressor housing containing the compression mechanism section and the motor. The location to form the suction port can be determined by considering the peripheral space of the compressor assembled in a vehicle, or the avoidance of the interference with other components.

It is preferable in designing and manufacturing that the second partition wall is formed integrally with a compressor housing containing the compression mechanism section and the motor. However, it is possible that the second partition wall which has been formed separately is firmly fixed to the compressor housing.

The first partition wall can be formed integrally with a drive circuit housing containing the drive circuit. However, when the compressor housing and the drive circuit housing are composed as an integrated housing as described above, it is preferred in assembling, specifically in assembling the drive circuit in the compressor, that a first partition wall forming member which is formed as a body which is separated from the integrated housing is inserted to be fixed thereto.

As to a disposition structure inside the compressor, the installation section of the motor, the refrigerant gas chamber and the installation section of the drive circuit may be disposed in this order in a compressor axial direction, and alternatively, the installation section of the motor, the refrigerant gas chamber and the installation section of the drive circuit may be disposed in this order in a compressor radial direction. The structure to be selected therebetween can be determined according to a situation of surroundings where the compressor is mounted.

Effect According to the Invention

Thus, in the electric compressor integral with a drive circuit according to the present invention, because the refrigerant gas chamber having the refrigerant gas expansion space into which refrigerant gas is introduced is formed between the installation section of the drive circuit and the installation section of the motor, the drive circuit side can be easily cooled effectively, and for the motor side, cooling the motor and lubricating the bearing section can be easily kept better.

Further, a desirably designed refrigerant gas chamber can be easily formed if the compressor housing and the drive circuit housing are separately composed and are assembled to form the refrigerant gas chamber. Also in a case where both housings are composed as an integrated housing, the housing itself can be easily manufactured, and a desirably designed refrigerant gas chamber can be easily formed by inserting the member different from the integrated housing forming the first partition wall to be fixed thereinto.

Further, more adequate cooling structure can be achieved by accordingly devising: the position and the number of the through hole of the second partition wall; the first partition wall structure at the refrigerant gas chamber side or at the drive circuit side; the structure where the guide plate is provided in the refrigerant gas chamber; and the structure of the suction port through which refrigerant gas is led into the refrigerant gas chamber, etc.

EXPLANATION OF SYMBOLS

Figure 1:
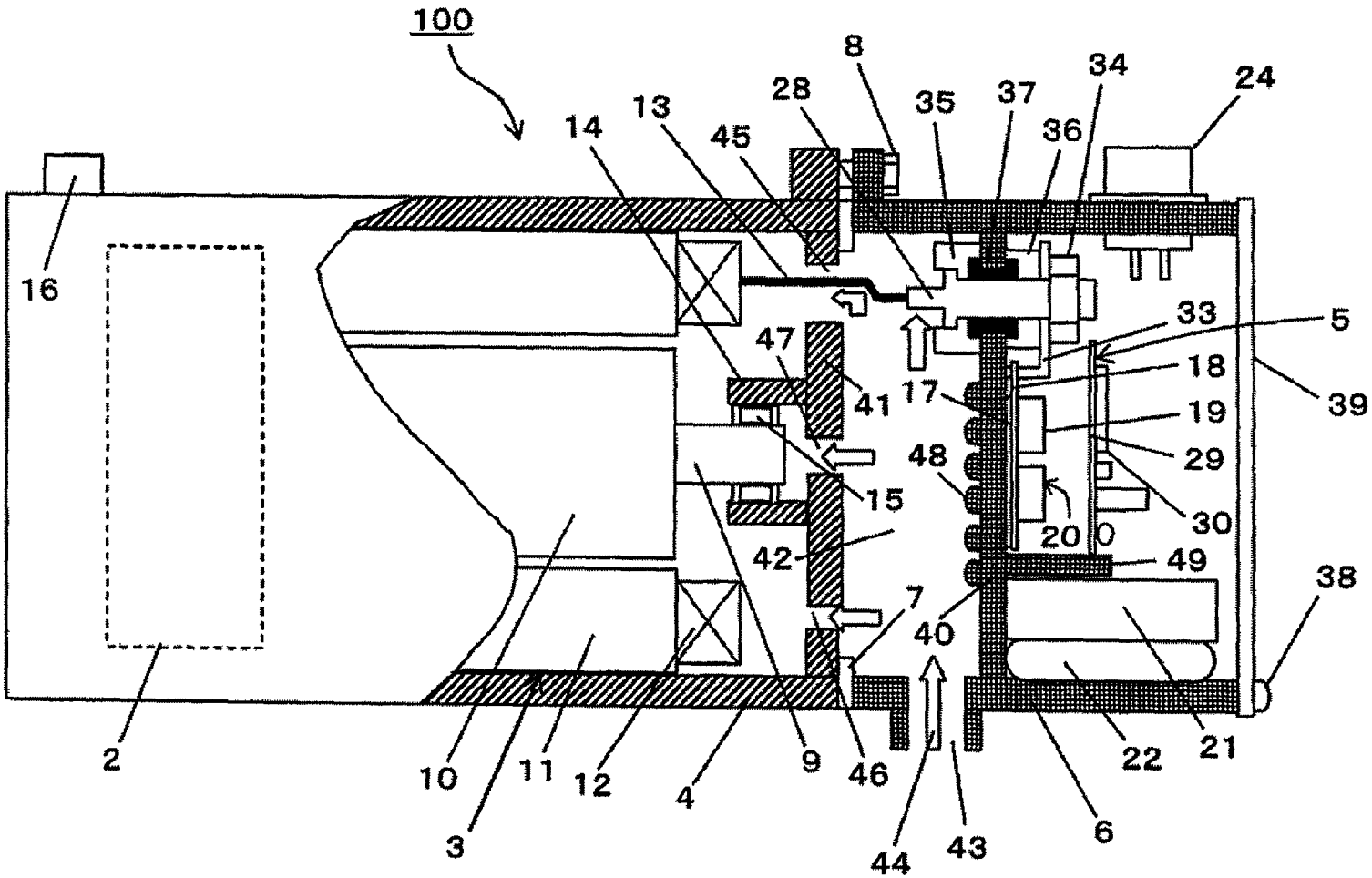
FIG. 1 is a longitudinal sectional view showing a main section of an electric compressor integral with a drive circuit according to the first embodiment of the present invention.

2: compression mechanism section
3: motor
4, 72, 81: compressor housing
5: drive circuit
6, 82: drive circuit housing
7: seal
8: bolt
9: motor rotational shaft
10: rotor
11: stator
12: motor winding section
13: winding terminal section
14: bearing housing
15: bearing
16: discharge port
17: insulating material
18: substrate
19: power semiconductor element
20: inverter circuit
21: smoothing capacitor as power circuit component
22: noise filter as power circuit component
23: battery as external power source
24: connector
25: bypass diode
26: IGBT
27: motor control circuit
28: sealed terminal
29: control circuit board
30: microcontroller
31: air-conditioner control units
32: connector for control signal
33: bus bar
34: screw nut
35, 36: terminal block
37: rubber bush
38: screw
39: lid
40, 51, 53: first partition wall
41: second partition wall
42, 83: refrigerant gas chamber
43, 71: refrigerant gas suction port
44: refrigerant gas
45, 46, 47: through hole
48: concavo-convex section
49: partition wall
52: protruded region
54: rib
55: sealed terminal installation hole
56: connector installation holes
57: connector installation hole for control signal
58: protrusion
59: vortex
61, 73: refrigerant gas guide plate
91: integrated housing
92: first partition wall forming member

100, 200, 300, 400, 500, 600, 700: electric compressor integral with drive circuit

THE BEST MODE FOR CARRYING OUT THE INVENTION

Figure 2:
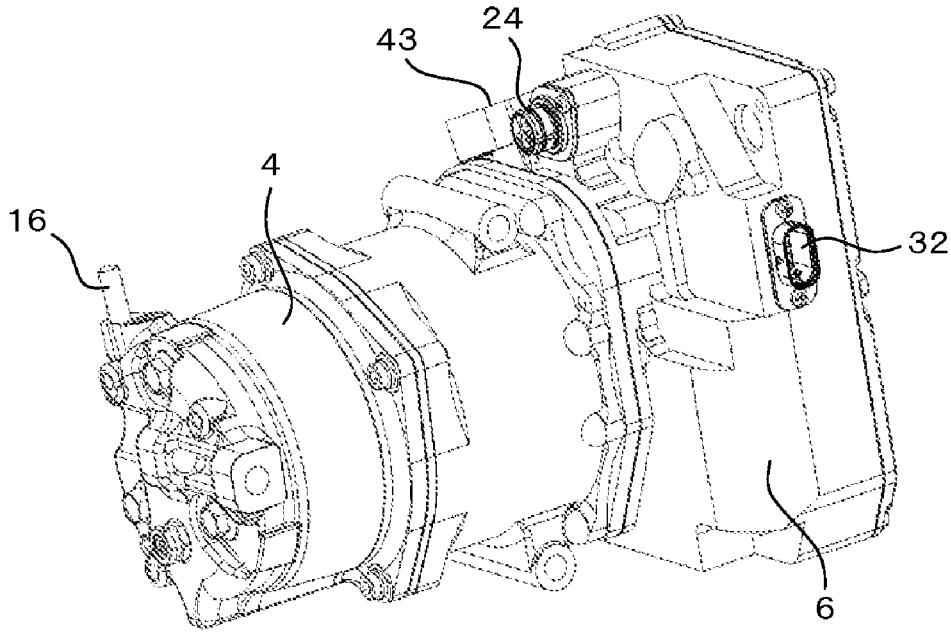
FIG. 2 is an exterior perspective view of the compressor in FIG. 1 in an assembled state.
Figure 3:
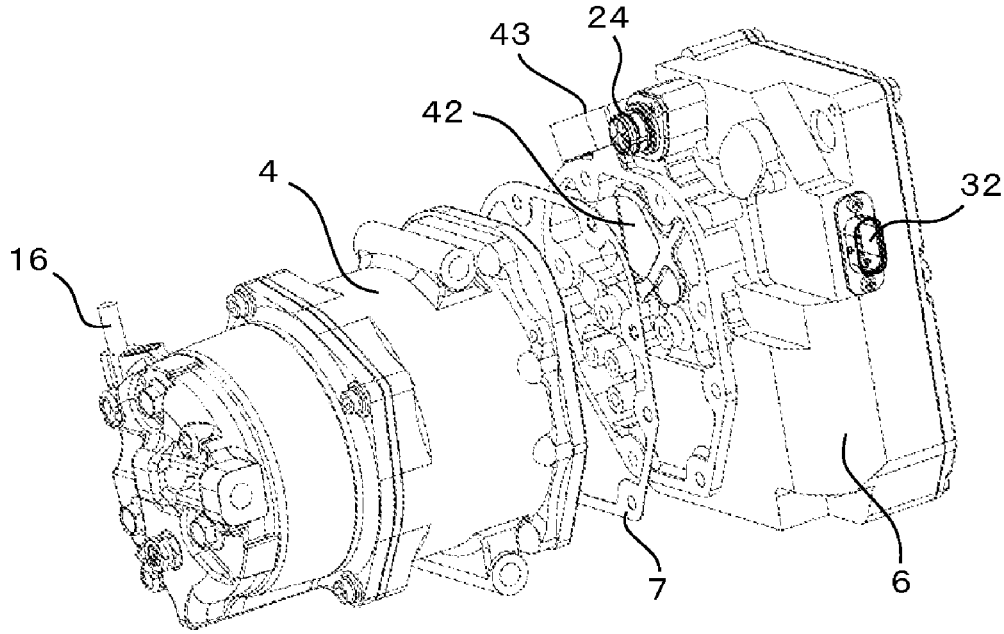
FIG. 3 is an exterior perspective view of the compressor in FIG. 1 in a state where housings have not yet been assembled.

Hereinafter, desirable embodiments will be explained referring to figures. FIGS. 1-3 show an electric compressor integral with a drive circuit according to the first embodiment of the present invention. FIG. 1 shows a schematic longitudinal sectional view of its main section. FIG. 2 shows an exterior perspective view in its assembled state. FIG. 3 shows an exterior perspective view in a state where housings have not yet been assembled. Here will be explained as referring to FIG. 1.

In FIG. 1, electric compressor integral with drive circuit 100 has compressor housing 4 and drive circuit housing 6, and compressor housing 4 contains compression mechanism section 2 and motor 3 which drives compression mechanism section 2, and drive circuit housing 6 which is separated from compressor housing 4 contains drive circuit 5 of motor 3, and both housings 4,6 are assembled as a whole housing of the compressor by bolt 8 and seal 7 such as gaskets and O-rings. Motor 3 comprises: motor rotational shaft 9 which may double as a drive shaft of compression mechanism 2; rotor 10 which is rotated integrally with motor rotational shaft; stator 11 disposed around rotor 10; and motor winding section 12 provided on stator 11. The electricity is supplied through winding terminal section 13 from drive circuit 5. One end of motor rotational shaft 9 is supported by bearing 15 which is provided in bearing housing 14, as freely rotatable. Compression mechanism section 2 is driven by motor 3, and refrigerant gas sucked into compressor housing 4 by the drive is compressed, and compressed refrigerant gas is discharged out of the compressor through discharge port 16.

Figure 10:
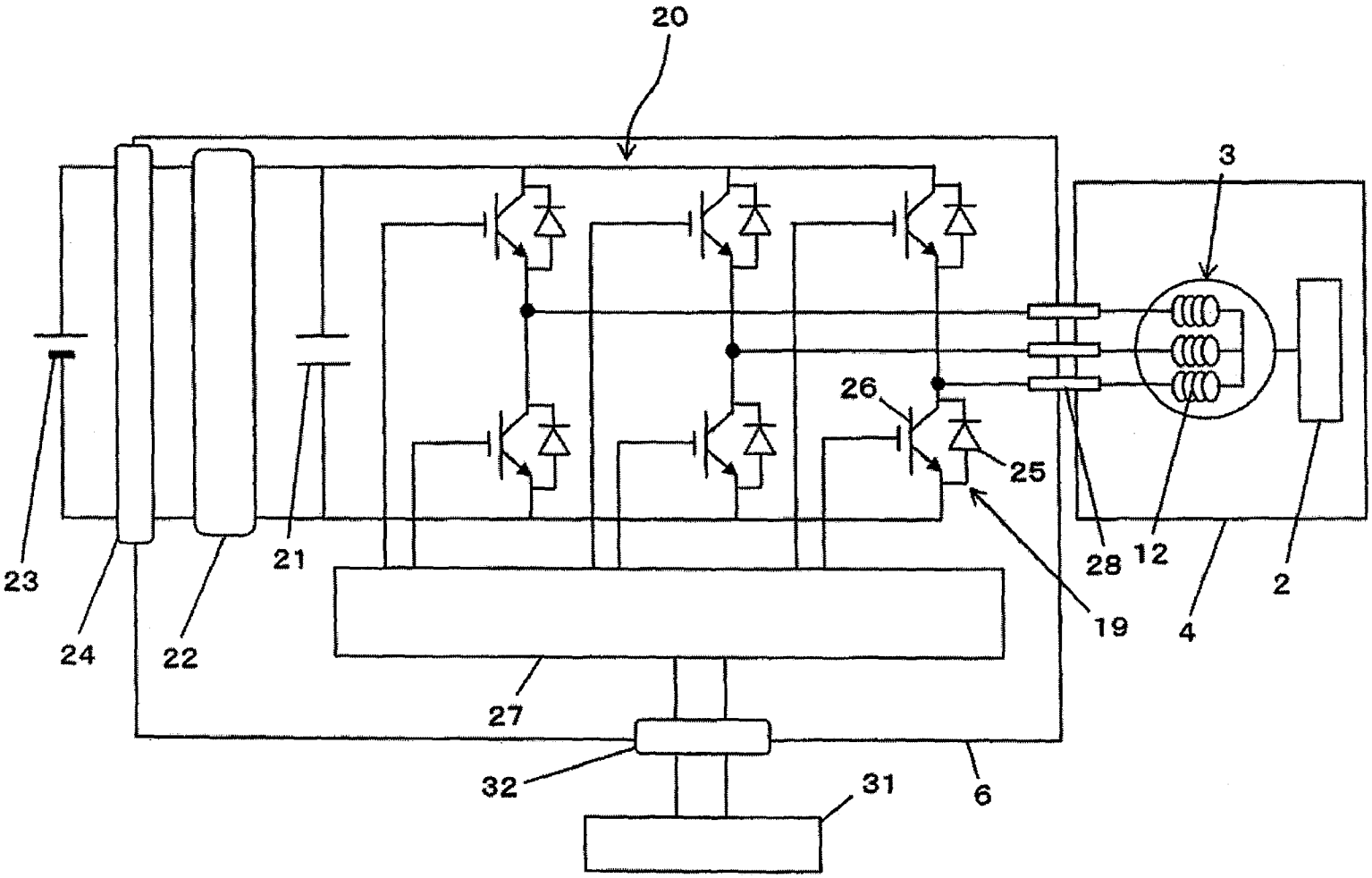
FIG. 10 is a circuit diagram showing a configuration example of a drive circuit of the present invention.

Drive circuit 5 comprises: inverter circuit 20 with substrate 18 which is fixed on an surface of the first partition wall to be described by insulation member 17 and power semiconductor element 19 which is disposed thereon; power circuit components, such as smoothing capacitor 21 and noise filter 22, which are disposed in the power dispatching section to inverter circuit 20. It is explained as referring to a circuit diagram in FIG. 10 that the electricity is supplied from battery 23 as an external power source to inverter circuit 20 via connector 24 provided at drive circuit housing 6, noise filter 22 and smoothing capacitor 21. Inverter circuit 20 comprises six pieces of power semiconductor elements 19, and each power semiconductor element 19 comprises bypass diode 25 and IGBT—Insulated Gate Bipolar Transistor—26, which is a transistor which controls the electricity supplied to motor 3. Each IGBT 26 is controlled by a signal output from motor control circuit 27, and the voltage output from inverter circuit 20 controlled in three-phase state is applied to winding section 12 of motor 3 through sealed terminal 28. Motor control circuit 27 has microcontroller 30 disposed on control circuit board 29, and is controlled based on the signal which is sent through connector for control signal 32 from air-conditioner control device 31. Connector for control signal 32 may be formed integrally with connector 24 for supplying electricity. The voltage output from inverter circuit 20 is input through bus bar 33 to sealed terminal 28, and bus bar 33 is fixed to sealed terminal 28 by screw nut 34. Sealed terminal 28 extends as penetrating the first partition wall to be described in a sealed state, and is fixed to the first partition wall by terminal blocks 35,36 and rubber bush 37. Thus constructed drive circuit 5 is contained in drive circuit housing 6 and drive circuit housing 6 is sealed by lid 39 fixed by screw 38.

Refrigerant gas chamber 42 formed by an expansion space of refrigerant gas into which refrigerant gas is introduced through first partition wall 40 provided on a side of the installation section of drive circuit 5 and second partition wall 41 provided on an opposite side thereof, which is a side of the installation section of motor 3. In this embodiment, first partition wall 40 is formed integrally with drive circuit housing 6 and second partition wall 41 is formed integrally with compressor housing 4. Refrigerant gas 44 is sucked from refrigerant gas suction port 43 provided in drive circuit housing 6 and is introduced into refrigerant gas chamber 42, and is once expanded in refrigerant gas chamber 42 in flowing in refrigerant gas chamber 42. Refrigerant gas chamber 42 is interrupted by first partition wall 40 against an installation section of drive circuit 5, and is communicated with an installation section of motor 3 by through holes 45,46,47 provided in second partition wall 41, through which refrigerant gas 44 can pass. Among these through holes, through hole 45 is provided at a position corresponding to an installation section of sealed terminal 28 which extends as penetrating through first partition wall 40, and through hole 46 is provided on second partition wall 41, at a position on a side opposite to through hole 45. Through hole 47 is formed as communicating with a section of bearing 15 of motor rotational shaft 9 in this embodiment. In addition, through hole 45 provided at a position corresponding to an installation section of sealed terminal 28 is formed as a through hole whose cross sectional area is larger than that of the other through holes 46,47. Further, in this embodiment concavo-convex section 48 with a concavo-convex structure is provided on a forming surface of refrigerant gas chamber 42 of first partition wall 40, so that a cooling surface area in this part is increased. Furthermore, in this embodiment partition wall 49 is provided between inverter circuit 20 in a part of drive circuit 5 and components, such as smoothing capacitor 21 and noise filter 22 but inverter circuit 20, so that smoothing capacitor 21 and noise filter 22 are disposed in a region sectioned by partition wall 49 against inverter circuit 20.

Thus constructed electric compressor integral with drive circuit 100 has a structure where an installation section of motor 3, refrigerant gas chamber 42 and an installation section of drive circuit 5 are disposed in this order in the compressor axial direction. Refrigerant gas 44 sucked through refrigerant gas suction port 43 is introduced into refrigerant gas chamber 42 having a comparatively larger volume, and drive circuit 5 is efficiently cooled through first partition wall 40 by refrigerant gas 44 flowing in refrigerant gas chamber 42. Motor 3 side is cooled by refrigerant gas 44 sucked via through hole 45,46,47 on second partition wall from the inside of refrigerant gas chamber 42, and refrigerant gas 44 which has been utilized for cooling is compressed by compression mechanism section 2 and discharged out of the compressor through discharge port 16. Because drive circuit housing 6 containing drive circuit 5 is composed separately from compressor housing 4, if only drive circuit housing 6 with first partition wall 40 is assembled with compressor housing 4, refrigerant gas chamber 42 can be easily formed into a desirable shape. By forming refrigerant gas chamber 42 with the desirable shape, drive circuit 5 can be surely cooled effectively. In addition, when both housing 4,6 are separately composed, only drive circuit housing 6 is formed as having a larger diameter relatively to compressor housing 4 which mainly determines a shell diameter of the compressor, so that the cooling area at the side of first partition wall 44 can be increased. Therefore drive circuit 5 can be cooled effectively while whole compressor 100 is miniaturized.

In addition, because the cross section of through hole 45 provided at a position corresponding to the installation section of sealed terminal 28 is set larger than the other through holes 46,47, most of refrigerant gas can be introduced into an installation section of sealed terminal 28 and then, can be delivered to motor 3 side. Thereby a part of sealed terminal 28 which generates heat and is required to be cooled more efficiently can be surely cooled efficiently.

In addition, because concavo-convex section 48 is provided on a forming surface of refrigerant gas chamber of first partition wall 40 so as to extend a surface area for heat exchange between refrigerant gas chamber 42 and first partition wall 40, drive circuit 5 can be cooled efficiently over a wide area through first partition wall 40.

Further, because smoothing capacitor 21 and noise filter 22 are disposed in a region which is partitioned by partition wall 49 against a power element circuit, smoothing capacitor 21 and noise filter which have relatively greater thermal capacities can be cooled from a whole periphery, so that even these components other than the power element circuit can be cooled efficiently.

Furthermore, because refrigerant gas including lubricating oil is introduced into a part of bearing 15 of motor rotational shaft 9 via through hole 47, the lubrication is ensured in a good condition as well as the cooling of this part, so that abnormal noise generation can be prevented and lifetime extension of bearing 15 can be expected.

Figure 4:
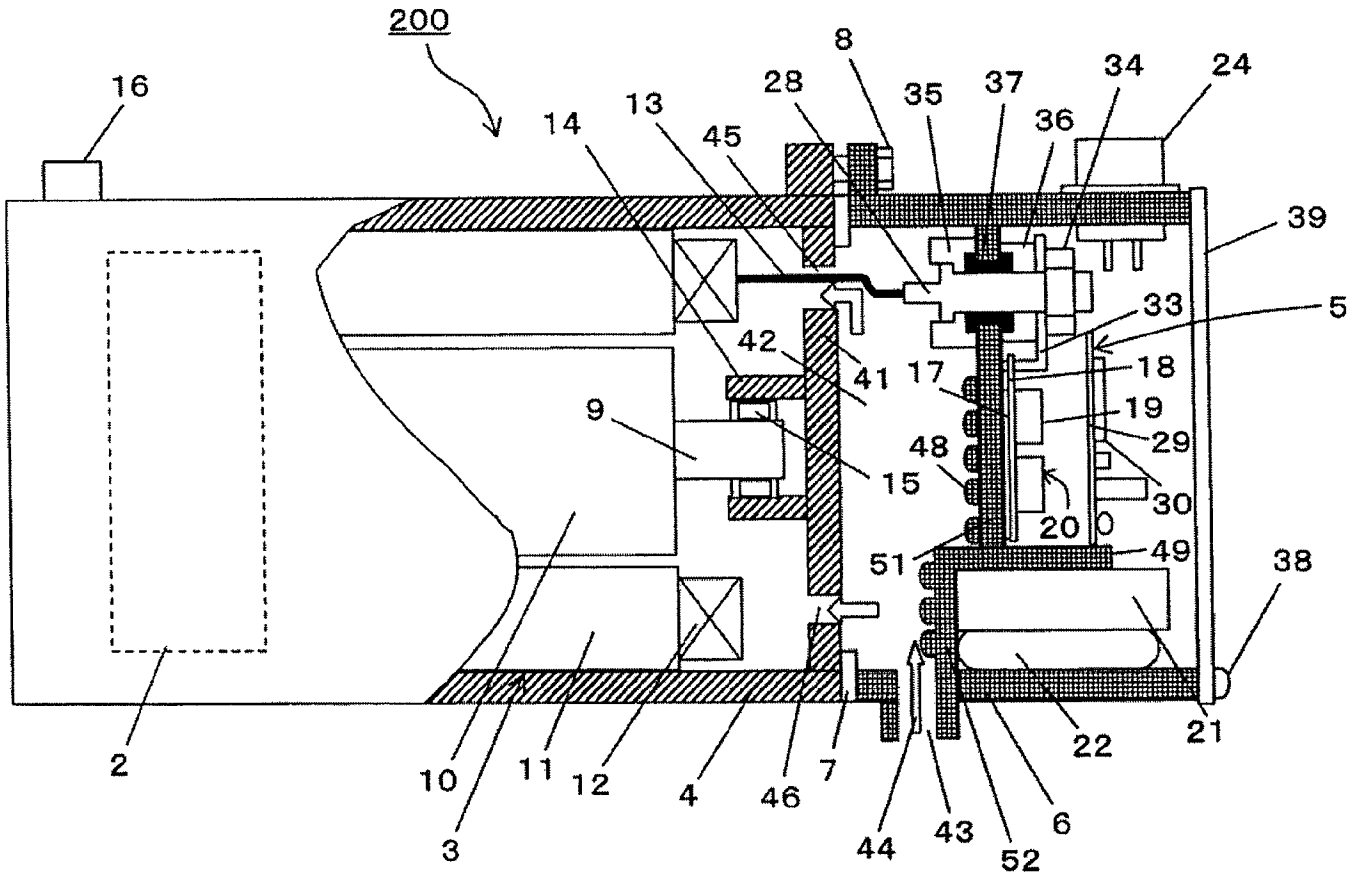
FIG. 4 is a longitudinal sectional view showing a main section of an electric compressor integral with a drive circuit according to the second embodiment of the present invention.

FIG. 4 shows electric compressor integral with drive circuit 200 according to the second embodiment of the present invention. In this embodiment, in comparison with the above-described first embodiment first partition wall 51 has protruded region 52 which protrudes into refrigerant gas chamber 42, and components, such as smoothing capacitor 21 and noise filter 22 as depicted, other than the power element circuit are disposed on a surface opposite to refrigerant gas chamber 42 in protruded region. Because at least some of these components 21,22 with relatively larger size can be contained in protruded region 52, the contact area between these components 21,22 and first partition wall 51 can be increased and the cooling effect by refrigerant gas chamber 42 can be developed. In addition, whole compressor 200 can be shortened in the axial direction, so that the compressor as a whole can be reduced in size and weight. Further, through hole 47 which communicates a part of bearing 15, which is not provided in an example depicted in FIG. 4, may be provided. Other composition, function and effect are pursuant to the first embodiment depicted in FIG. 1.

Figure 5:
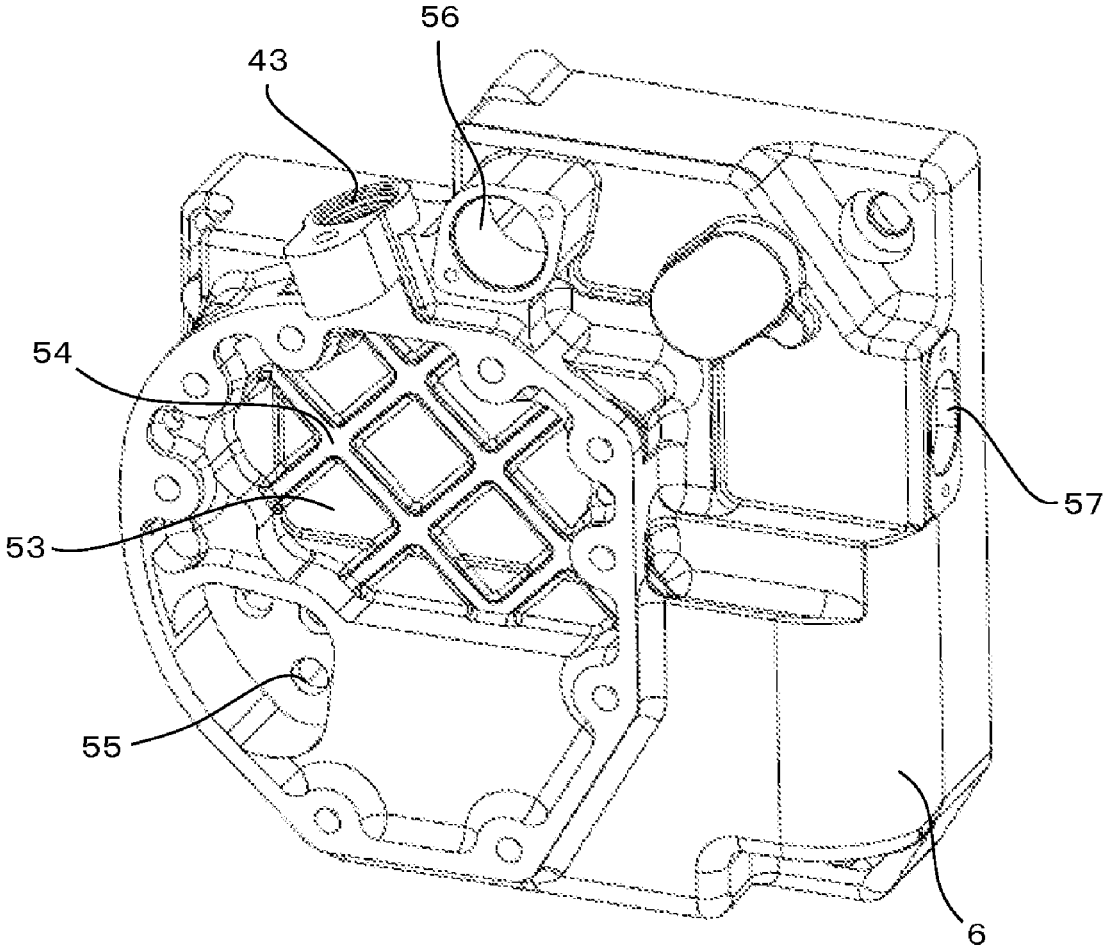
FIG. 5 is a perspective view of a drive circuit housing of an electric compressor integral with a drive circuit according to the third embodiment of the present invention.

FIG. 5 shows drive circuit housing 6 with first partition wall 53 of electric compressor integral with drive circuit according to the third embodiment of the present invention, where, in comparison with the above-described first embodiment, a rib structure with ribs 54 which extend like a lattice is formed as a concavo-convex structure on a forming surface of refrigerant gas chamber of first partition wall 53, integrally with first partition wall 53. Because ribs 54 are provided, the strength of first partition wall 53 can be increased, and the surface area can be increased so as to promote the heat exchange with refrigerant gas. In addition, the strength and the heat exchange performance can be further improved by forming ribs 54 like a lattice. Other composition, function and effect are pursuant to the first embodiment depicted in FIG. 1. In FIG. 5, symbol 55 implies a sealed terminal installation hole, symbol 56 implies a connector installation hole and symbol 57 implies a connector installation hole for a control signal.

Figure 6:
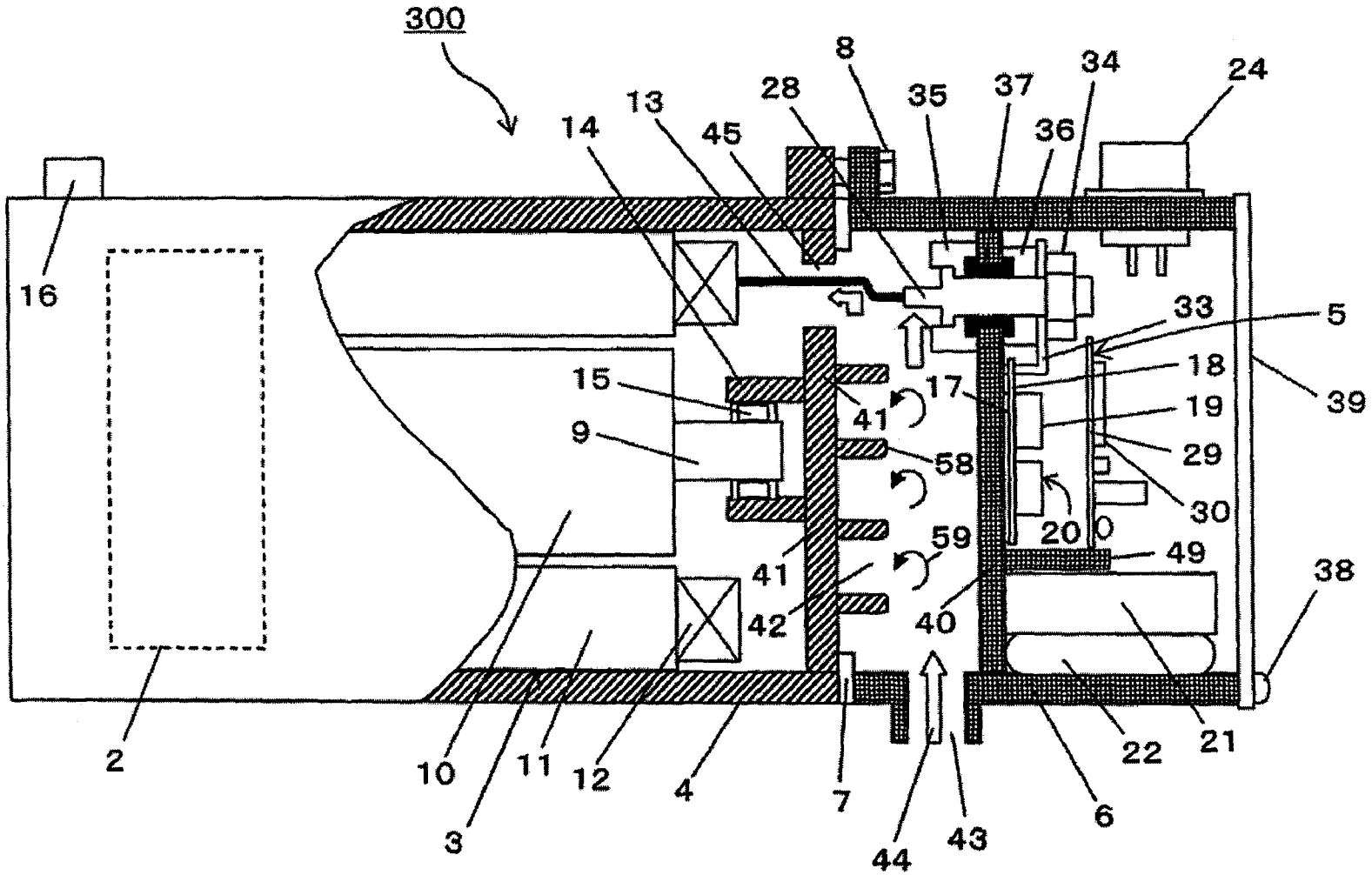
FIG. 6 is a longitudinal sectional view showing a main section of an electric compressor integral with a drive circuit according to the fourth embodiment of the present invention.

FIG. 6 shows electric compressor integral with drive circuit 300 according to the fourth embodiment of the present invention, where, in comparison with the above-described first embodiment, protrusions 58 which obstruct a flow of refrigerant gas in refrigerant gas chamber 42 are provided on a surface forming refrigerant gas chamber 42 of second partition wall 41 while protrusions 58 are disposed in the direction of refrigerant gas flow. These protrusions 58 can be formed by integrating with second partition wall 41, for example. By providing such protrusions 58, vortex 59 is generated near protrusion 58 in refrigerant gas chamber 42 and the detention time of refrigerant gas is extended as the flow route of refrigerant gas extends and therefore, heat exchange with power semiconductor element 19 through first partition wall 40 is promoted so that the more effective cooling can be performed, for example. In addition, because the amount of refrigerant gas which flows near a surface of both partition walls 40,41 in refrigerant gas chamber 42 increases, further promotion of the heat exchange can be expected. Furthermore, because the cooling of second partition wall 41 is further promoted, even the cooling of bearing 15 of motor rotational shaft 9 through second partition wall 41 can be promoted, so that the lifetime of bearing 15 can be extended. Other composition, function and effect are pursuant to the first embodiment depicted in FIG. 1.

Figure 7:
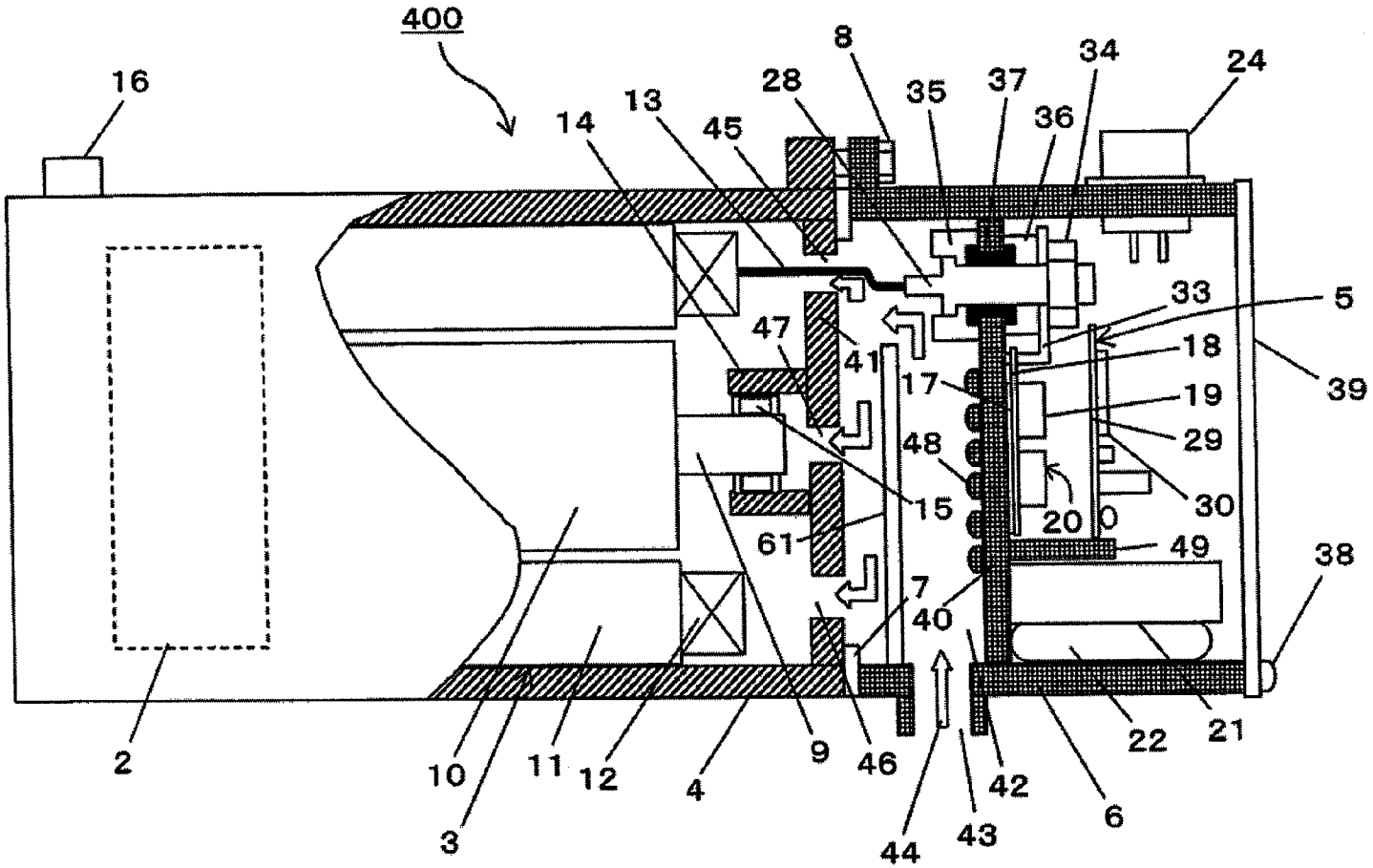
FIG. 7 is a longitudinal sectional view showing a main section of an electric compressor integral with a drive circuit according to the fifth embodiment of the present invention.

FIG. 7 shows electric compressor integral with drive circuit 400 according to the fifth embodiment of the present invention, where, in comparison with the above-described first embodiment, refrigerant gas guide plate 61 which guides refrigerant gas into refrigerant gas chamber 42 is provided. By refrigerant gas guide plate 61, refrigerant gas 44 can be more ensured to flow desirably, so that the cooling can be performed more efficiently. In this embodiment, refrigerant gas guide plate 61 is formed into a shape which guides refrigerant gas 44 which is introduced into refrigerant gas chamber 42 along first partition wall 40 at first and then guides to a side of second partition wall 41. Thereby refrigerant gas can be led to sealed terminal 28 section as cooling drive circuit 5 side adequately over a wide range, so that, specifically for drive circuit 5 side, the whole cooling effect can be increased and local cooling effect can be enhanced. Other composition, function and effect are pursuant to the first embodiment depicted in FIG. 1.

Figure 8:
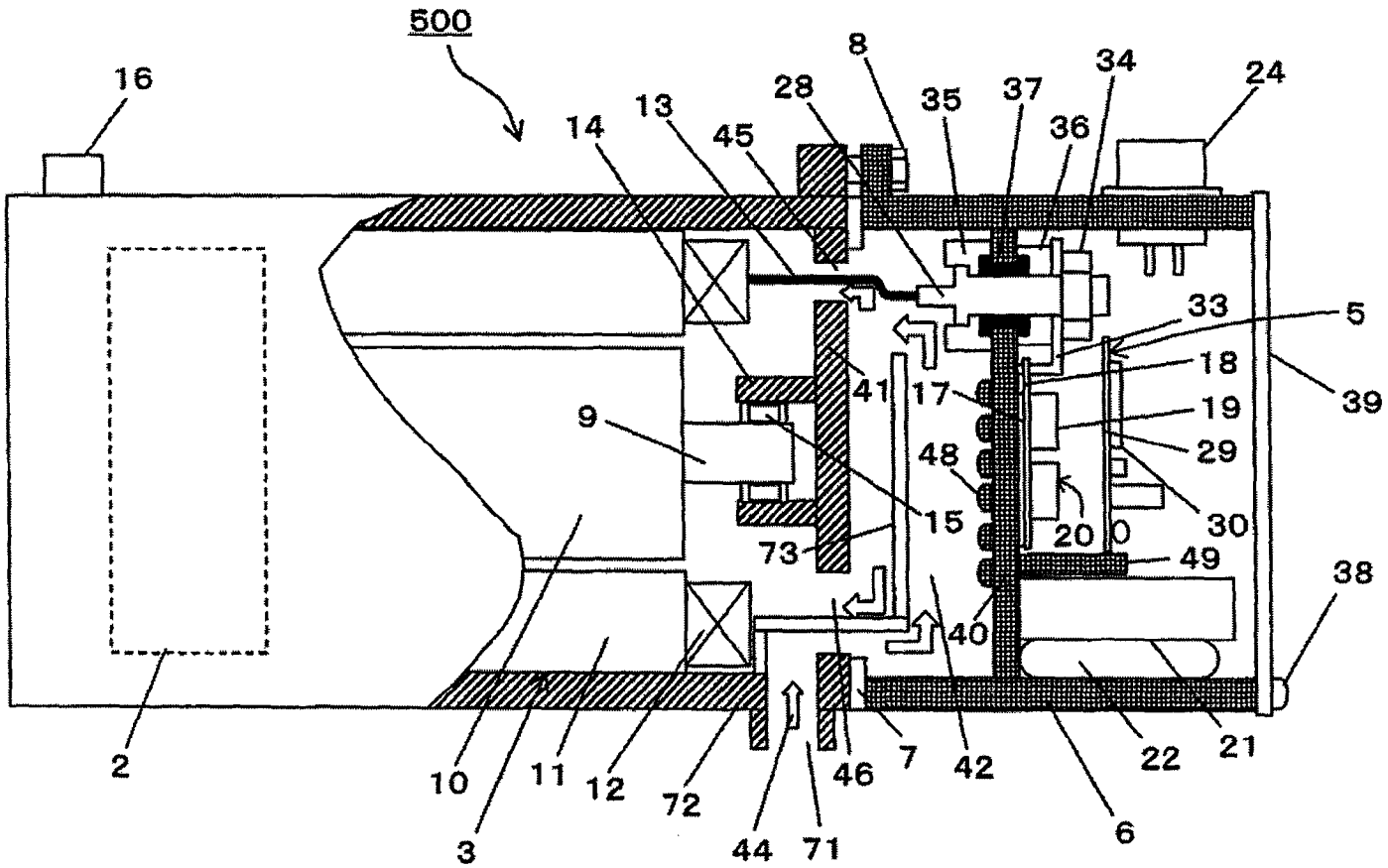
FIG. 8 is a longitudinal sectional view showing a main section of an electric compressor integral with a drive circuit according to the sixth embodiment of the present invention.

FIG. 8 shows electric compressor integral with drive circuit 500 according to the sixth embodiment of the present invention, where, in comparison with the above-described first embodiment, suction port 71 of refrigerant gas 44 is formed on a side of compressor housing 72 which contains compression mechanism section 2 and motor 3. The location to form the suction port of refrigerant gas, which may be provided on drive circuit side or which may be on compressor housing 72 side as depicted, can be determined by considering the peripheral space of the compressor or the avoidance of the interference with other components. In this embodiment, in connection with providing suction port 71 on compressor housing 72 side, refrigerant gas guide plate 73 is formed into a bent shape. Through hole 47 which communicates a part of bearing 15, which is not provided in an example depicted in FIG. 6, may be provided. Other composition, function and effect are pursuant to the first embodiment depicted in FIG. 1.

Figure 9:
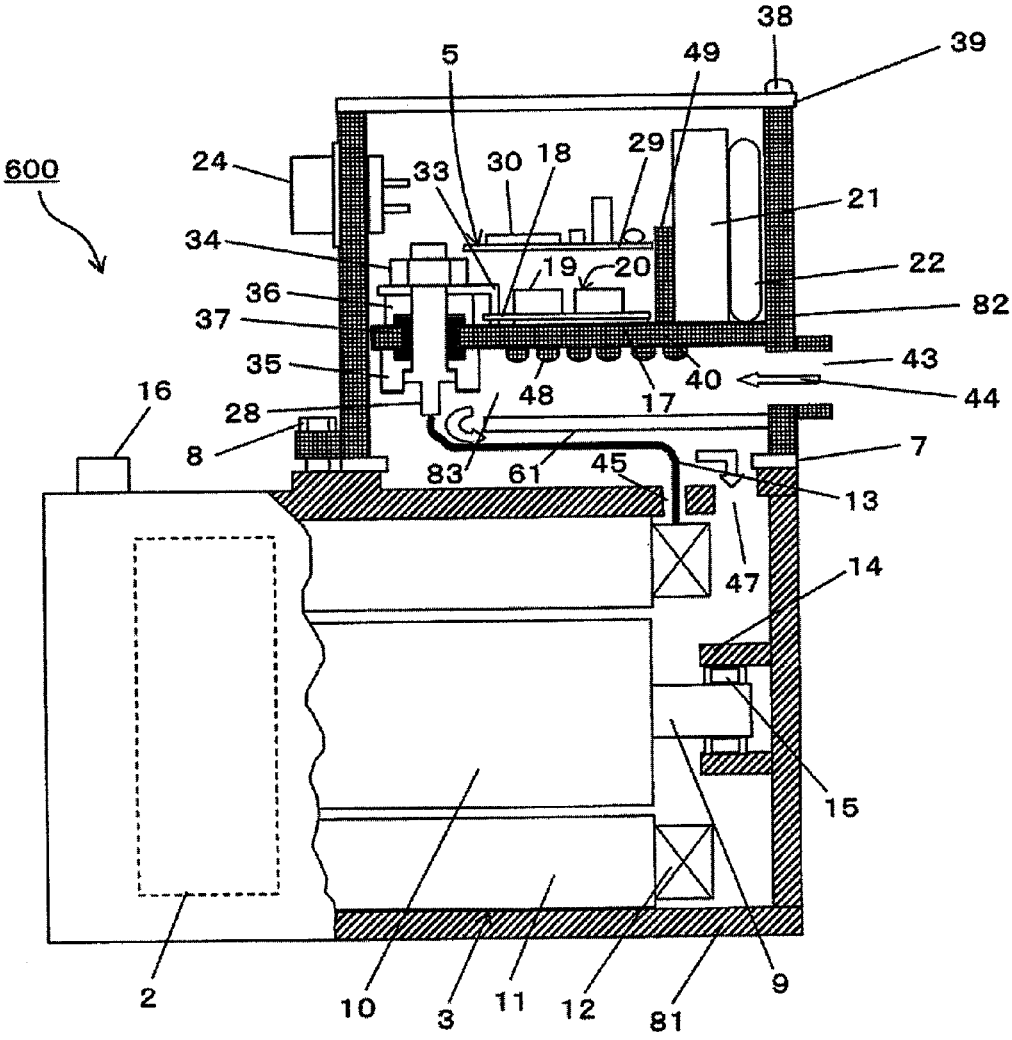
FIG. 9 is a longitudinal sectional view showing a main section of an electric compressor integral with a drive circuit according to the seventh embodiment of the present invention.

FIG. 9 shows electric compressor integral with drive circuit 600 according to the seventh embodiment of the present invention, where, in comparison with the above-described first embodiment, drive circuit housing 82 is assembled on compressor housing 81, and refrigerant gas chamber 83 is formed therebetween. In other words, an installation section of motor 3, refrigerant gas chamber 83 and an installation section of drive circuit 5 are disposed in this order in the radial direction of compressor 600. The disposition of installation section of motor 3, refrigerant gas chamber 83 and an installation section of drive circuit 5, whether they are disposed in the radial direction of compressor 600 or in the compressor axial direction, can be selected properly like the above-described embodiment according to a situation of surroundings where the compressor is mounted. Other composition, function and effect are pursuant to the first embodiment depicted in FIG. 1.

Figure 11:
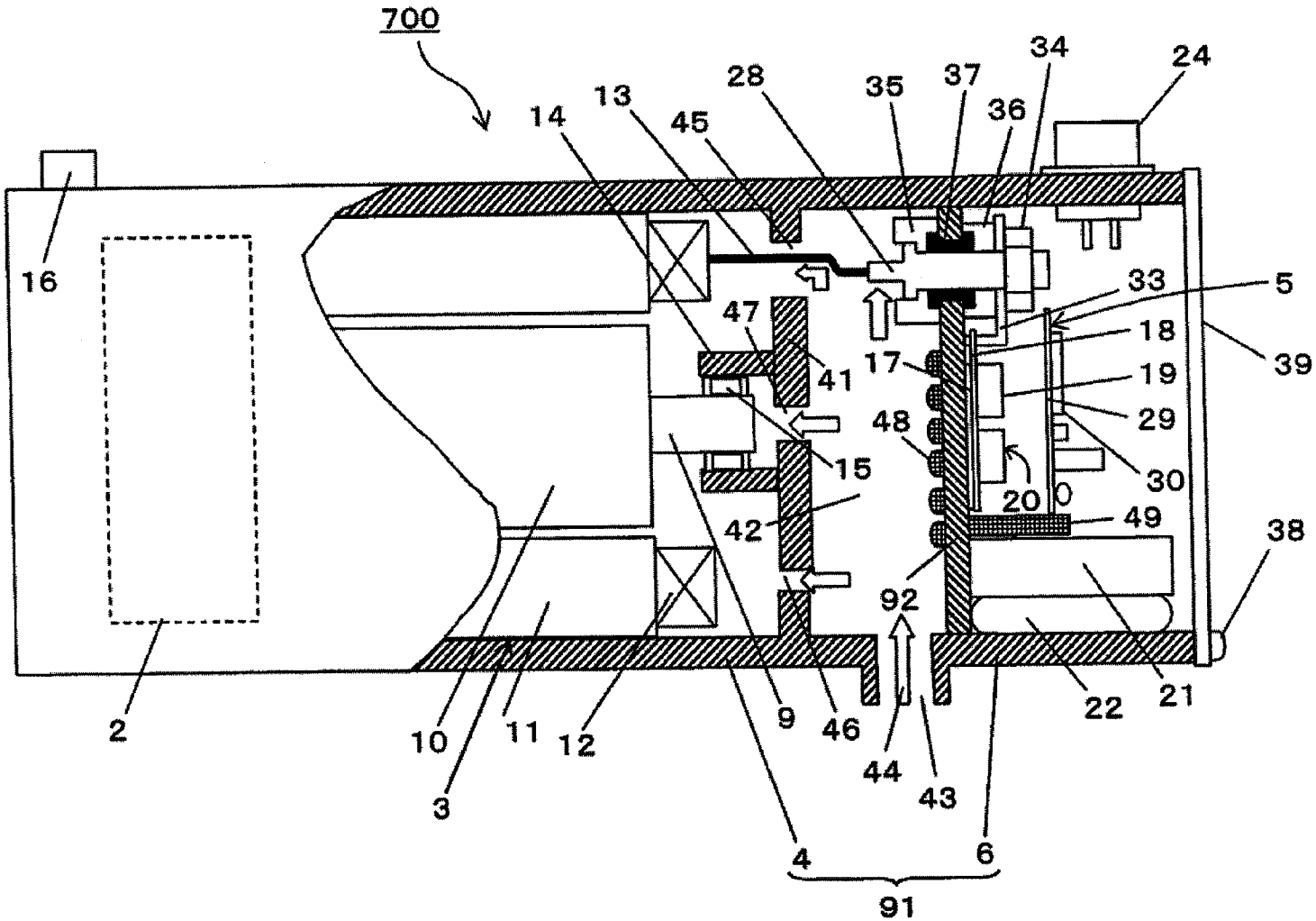
FIG. 11 is a longitudinal sectional view showing a main section of an electric compressor integral with a drive circuit according to the eighth embodiment of the present invention.

In each embodiment, although the compressor housing and the drive circuit housing are separately provided and assembled to form the refrigerant gas chamber, alternatively both housings can be composed integrally in the present invention. FIG. 11 shows electric compressor integral with drive circuit 700 according to the eighth embodiment of the present invention, where, in comparison with the above-described first embodiment, compressor housing 4 as a compressor housing part and drive circuit housing 6 as a drive circuit housing part are composed as integrated housing 91. In this case, it is difficult to form both first partition wall and second partition wall 41 as integrated together with integrated housing 91. Therefore the first partition wall can comprise first partition wall forming member 92 which is separated from integrated housing 91, and this member 92 can be inserted to be fixed into integrated housing 91, so that a desirably designed refrigerant gas chamber 42 is formed. Other composition, function and effect are pursuant to the first embodiment depicted in FIG. 1.

INDUSTRIAL APPLICATIONS OF THE INVENTION

The structure of an electric compressor integral with a drive circuit according to the present invention is applicable to an electric compressor incorporating only a motor as a drive source as well as so-called hybrid compressor which incorporates a first compression mechanism driven by an external drive source and a second compression mechanism which can be driven independently from the first compression mechanism by an onboard motor. Specifically it is preferably used as an electric compressor used for vehicles.

The invention claimed is:

1. An electric compressor integral with a drive circuit, comprising a compression mechanism section and a motor for driving said compression mechanism section, and said motor comprising said drive circuit for driving said motor, a refrigerant gas chamber comprising a refrigerant gas expansion space formed therein, into which refrigerant gas is introduced, wherein said refrigerant gas chamber is formed between an installation section of said drive circuit and an installation section of said motor by a first partition wall disposed on a side of said installation section of said drive circuit and a second partition wall disposed on a side opposite said drive circuit installation section side, which is a side of said installation section of said motor, wherein said refrigerant gas chamber is separated by said first partition wall from said installation section of said drive circuit, and is in communication with said installation section of said motor by a through hole, formed in said second partition wall, through which said refrigerant gas passes, and wherein said drive circuit comprises an inverter circuit comprising a power semiconductor element and power circuit components comprising a smoothing capacitor and a noise filter, which are disposed in a electricity supply section for said inverter circuit, said first partition wall has a region which protrudes into said refrigerant gas chamber, and said power circuit components are disposed on a surface of said protruded region, disposed at a side opposite to said refrigerant gas chamber.

2. The electric compressor according to claim 1, further comprises a compressor housing, which contains said compression mechanism section and said motor, and a drive circuit housing, which contains said drive circuit, said first partition wall is disposed in said drive circuit housing, and said refrigerant gas chamber is formed between said drive circuit housing and said compressor housing.

3. The electric compressor according to claim 1, wherein a compressor housing, which comprises said compression mechanism section and said motor, and a drive circuit housing, which comprises said drive circuit, are an integrated housing, and said refrigerant gas chamber is formed by a member forming said first partition wall, which is fixed into said integrated housing.

4. The electric compressor according to claim 1, wherein said through hole is formed in said second partition wall, at a position corresponding to an installation section of a sealed terminal for supplying an electricity to said motor, sealed terminal extending through said first partition wall from said drive circuit.

5. The electric compressor according to claim 1, wherein a plurality of through holes are formed in said second partition wall.

6. The electric compressor according to claim 5, wherein said plurality of through holes comprises a through hole with a relatively larger cross section and a through hole with a relatively smaller cross section.

7. The electric compressor according to claim 6, wherein a through hole which is provided on said second partition wall at a position corresponding to an installation section of a sealed terminal for supplying an electricity to said motor, said sealed terminal extending through said first partition wall from said drive circuit, is said through hole with the relatively larger cross section.

8. The electric compressor according to claim 1, wherein a through hole which communicates from said refrigerant gas chamber to a bearing section for a rotational shaft of said motor is formed in said second partition wall.

9. The electric compressor according to claim 1, wherein a concavo-convex structure is formed on a surface forming said refrigerant gas chamber of said first partition wall.

10. The electric compressor according to claim 9, wherein said concavo-convex structure on said surface forming said refrigerant gas chamber of said first partition wall is formed as a rib structure for said first partition wall.

11. The electric compressor according to claim 10, wherein said rib structure comprises a plurality of ribs which extend to form a lattice.

12. The electric compressor according to claim 1, wherein a protrusion which obstructs a flow of said refrigerant gas in said refrigerant gas chamber is disposed on a surface forming said refrigerant gas chamber of said second partition wall.

13. The electric compressor according to claim 12, wherein a plurality of protrusions are disposed.

14. The electric compressor according to claim 1, wherein said power circuit components are disposed in a region which is partitioned relatively to said inverter circuit by a partition wall.

15. The electric compressor according to claim 1, wherein a refrigerant gas guide plate is disposed in said refrigerant gas chamber.

16. The electric compressor according to claim 15, wherein said refrigerant gas guide plate is formed into a shape which guides refrigerant gas, introduced into said refrigerant gas chamber to a side of said second partition wall, after guiding said refrigerant gas along said first partition wall.

17. The electric compressor according to claim 1, wherein a suction port conveying said refrigerant gas into said refrigerant gas chamber is formed on a drive circuit housing comprising said drive circuit.

18. The electric compressor according to claim 1, wherein a suction port conveying said refrigerant gas to an inside of said refrigerant gas chamber is formed on a compressor housing comprising said compression mechanism section and said motor.

19. The electric compressor according to claim 1, wherein said second partition wall is formed integrally with a compressor housing comprising said compression mechanism section and said motor.

20. The electric compressor according to claim 1, wherein said first partition wall is formed integrally with a drive circuit housing comprising said drive circuit.

21. The electric compressor according to claim 1, wherein said installation section of said motor is disposed adjacent to said refrigerant gas chamber and said refrigerant gas chamber is disposed adjacent to said installation section of said drive circuit, in a compressor axial direction.

22. The electric compressor according to claim 1, wherein said installation section of said motor is disposed adjacent to said refrigerant gas chamber and said refrigerant gas chamber is disposed adjacent to said installation section of said drive circuit, in a compressor radial direction.

* * * * *